US006432004B1

(12) United States Patent
Nemeckay

(10) Patent No.: US 6,432,004 B1
(45) Date of Patent: Aug. 13, 2002

(54) TENNIS TRAINING DEVICE

(76) Inventor: Stephen A. Nemeckay, 11060 Peerless, Detroit, MI (US) 48224

( * ) Notice: Subject to any disclaimer, the term of this patent is extended or adjusted under 35 U.S.C. 154(b) by 0 days.

(21) Appl. No.: 09/664,900

(22) Filed: Sep. 19, 2000

Related U.S. Application Data

(60) Continuation-in-part of application No. 08/941,415, filed on Sep. 30, 1997, now Pat. No. 6,120,385, which is a continuation-in-part of application No. 08/685,441, filed on Jul. 23, 1996, now Pat. No. 5,836,627, which is a division of application No. 08/312,816, filed on Sep. 27, 1994, now Pat. No. 5,538,299.

(51) Int. Cl.[7] ..... A63B 49/04
(52) U.S. Cl. ..... 473/519; 473/463
(58) Field of Search ..... 473/463, 553, 473/422, 461, 459

(56) References Cited

U.S. PATENT DOCUMENTS

| | | | | | |
|---|---|---|---|---|---|
| 1,186,283 | A | * | 6/1916 | Coddington | 473/519 |
| 4,027,881 | A | * | 6/1977 | Hufenus | 473/519 |
| 4,179,121 | A | * | 12/1979 | Kelmanski | 473/519 |
| 4,427,195 | A | * | 1/1984 | Hufenus | 473/519 |
| 4,690,406 | A | * | 9/1987 | Hufenus | 473/519 |
| 5,215,307 | A | * | 6/1993 | Huffman | 473/463 X |
| 5,538,299 | A | * | 7/1996 | Nemeckay | 292/305 |
| 5,836,627 | A | * | 11/1998 | Nemeckay | 292/305 |
| 6,120,385 | A | * | 9/2000 | Nemeckay | 473/256 |

FOREIGN PATENT DOCUMENTS

| | | | | |
|---|---|---|---|---|
| FR | 2235714 | * | 3/1975 | 473/FOR 181 |
| GB | 1494517 | * | 12/1977 | 473/FOR 181 |
| GB | 1596183 | * | 8/1981 | 473/FOR 181 |

* cited by examiner

*Primary Examiner*—Raleigh Chiu
(74) *Attorney, Agent, or Firm*—Plunkett & Cooney PC; Arnold S. Weintraub

(57) ABSTRACT

A tennis training device for aiding in tennis-swing training and warm-up exercises includes a tennis racket or like-shaped frame having handle and head portions spaced apart along a central axis, a central opening disposed between the frame portions, an axial shaft the opposite ends of which are removably mounted to the head and handle of the frame, and at least one weight member removably, slidably, securedly, mounted to the shaft at a preselected location in the central opening whereby to enable the player to adjust the center of gravity and weight balance of the frame. In a preferred embodiment, two temporary lockable interdigitating members and a locking member that engages the shaft to position the weight member at the preselected location define the weight member.

14 Claims, 4 Drawing Sheets

FIG 1
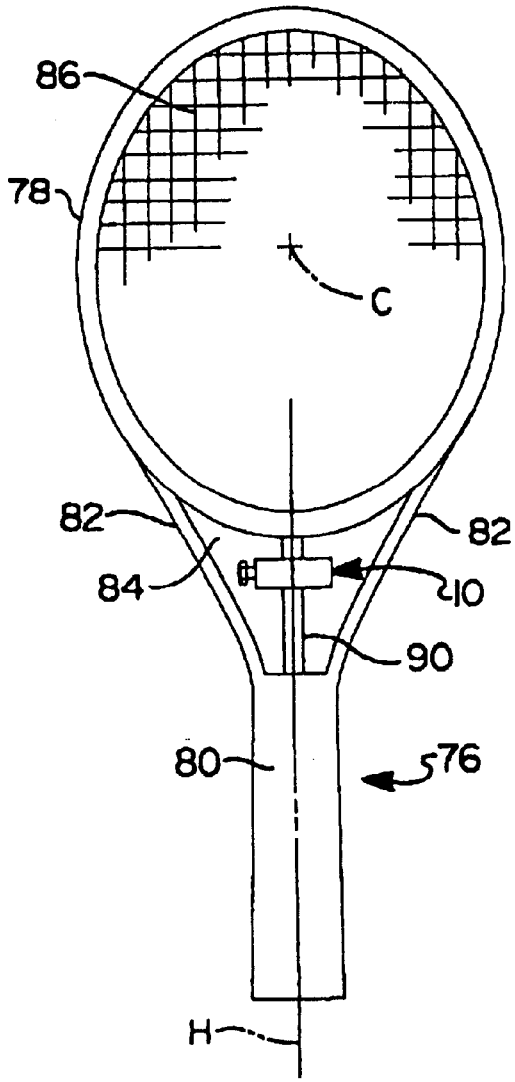
FIG 2A
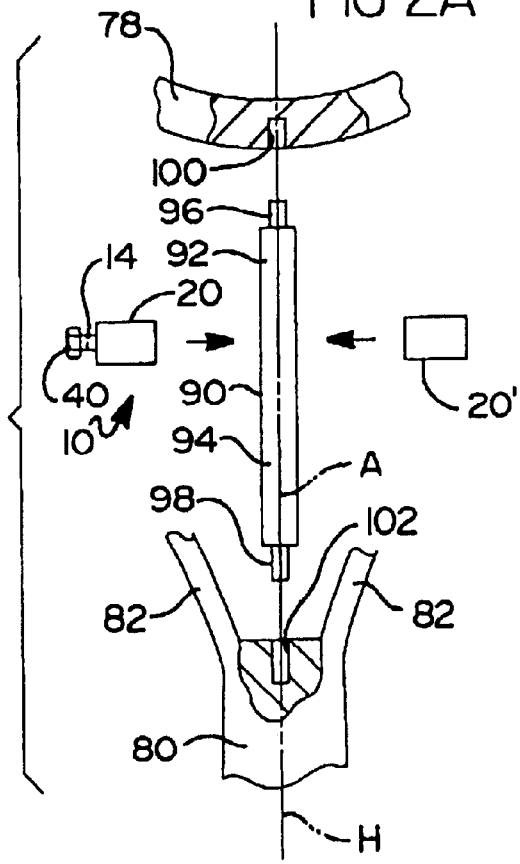
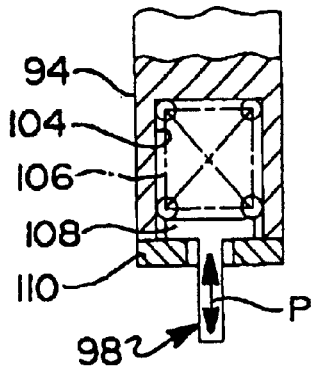
FIG 2B

FIG 3
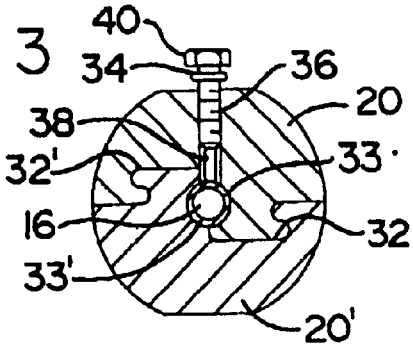
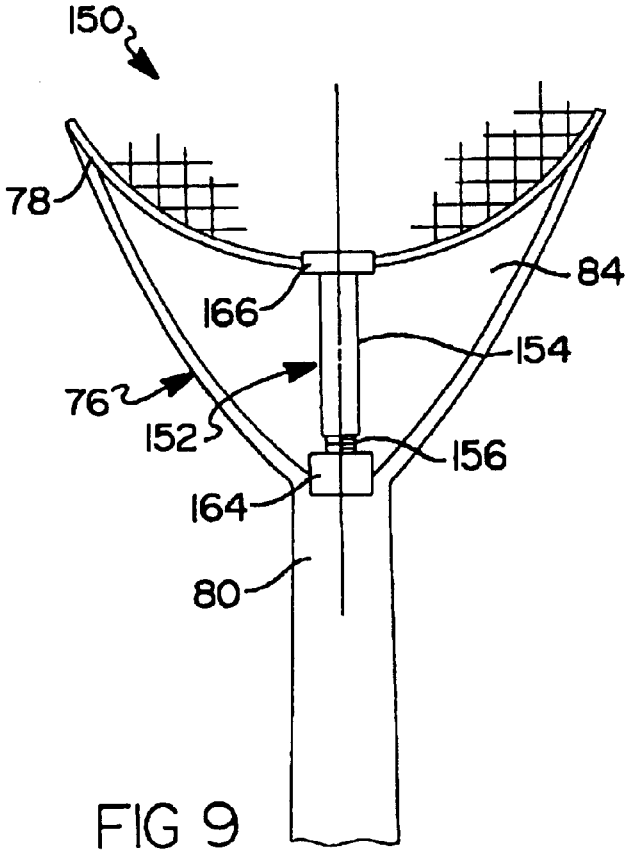
FIG 9
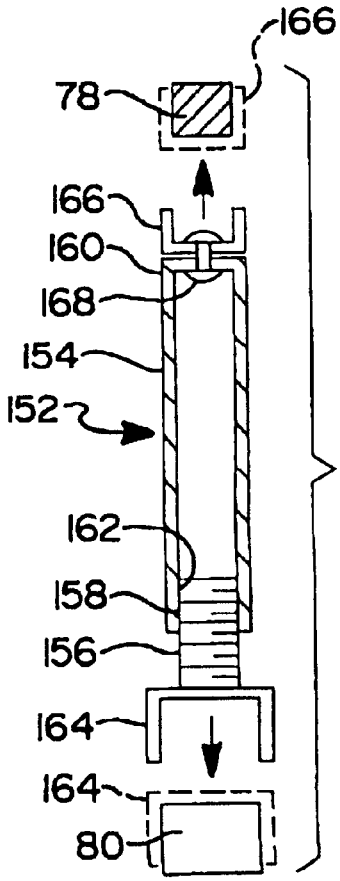
FIG 10

FIG 6
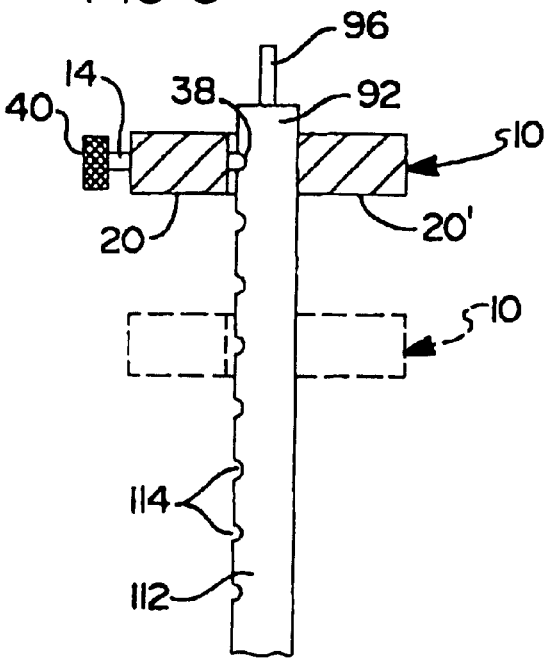
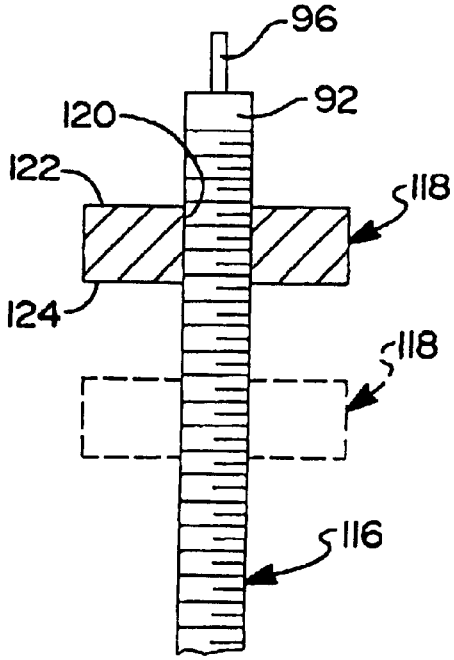
FIG 7
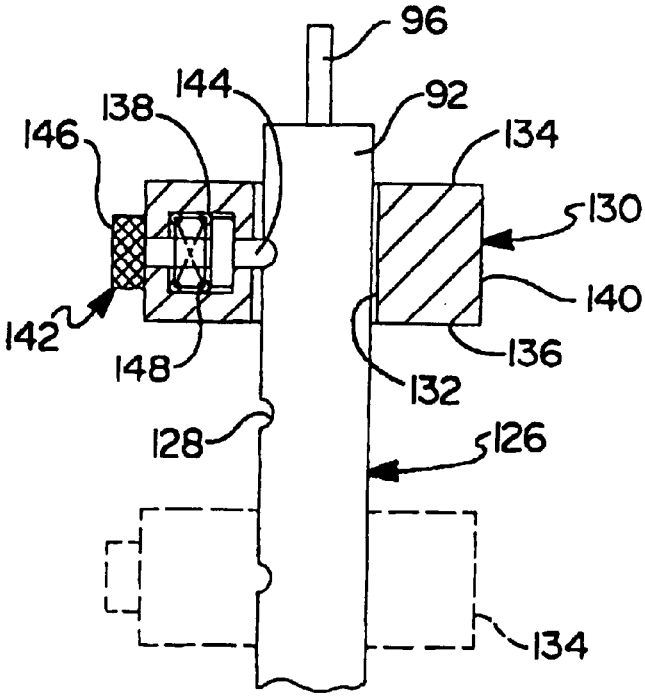
FIG 8

TENNIS TRAINING DEVICE

CROSS REFERENCE TO PENDING APPLICATION

This application is a continuation-in-part of co-pending U.S. patent application Ser. No. 08/941,415, filed Sep. 30,1997, for "Golf Training Device", issuing Sep. 19, 2000 as U.S. Pat. No. 6,120,385, which application is a continuation-in-part of U.S. patent application Ser. No. 08/685,441, filed Jul. 23, 1996, for "Housing and Securing Device", issuing Nov. 17, 1998 as U.S. Pat. No. 5,836,627, which is a divisional Patent Application of patent application Ser. No. 08/312,816, filed Sep. 27, 1994, issuing Jul. 23, 1996 as U.S. Pat. No. 5,538,299, the disclosures of which are specifically incorporated herein by reference.

BACKGROUND OF THE INVENTION

1. Field of the Invention

The present invention relates generally to tennis. More particularly, the present invention concerns weighted tennis training devices. Even more particularly, the present invention concerns weighted tennis-swing training devices.

2. Prior Art

In the above referred to co-pending application and issued patent, there is disclosed a locking device which may be removably secured about a shaft. The device is defined by interdigitated opposingly arranged body portions that are locked together by way of a helically threaded fastener. The body portions cooperate to define a body member having a central aperture formed therethrough, which enables the device to be secured to the shaft.

It has now been discovered that the principles embodied in the locking device thereof may be used to provide training devices to improve a player's tennis swing. It is to this to which the present invention is directed.

SUMMARY OF THE INVENTION

In accordance with the present invention there is provided a training device for improving a player's tennis swing. According to this aspect, the tennis-swing training device generally, comprises:

(a) a racket, said racket comprising a stringed head having a lower end portion, a handle having an upper end portion, and a pair of beams connecting the head to the handle and defining an open area between the upper and lower end portions thereof;

(b) a shaft having a first end and a second end and a medial portion between the ends of the shaft;

(c) means for mounting the shaft to the racket whereby the first end is proximate to the upper end portion of the handle, the second end is proximate to the lower end portion of the head, and the medial portion is proximate to the open area; and (d) means movably mounted on the medial portion of the shaft and positionable in the open area for changing the balance and the resultant center of gravity of the tennis racket, wherein said means movably mounted on the medial portion of said shaft comprises a weight mounted for movement in the opening between the head and handle portions, the weight comprising:

(1) first and second interdigitating opposedly arranged body portions; and (2) at least one locking member for locking the first and second body portions together and securing the body portions to the shaft thereby precluding the slidable movement of the shaft relative to the body member.

At least one of the two body portions of the weight has a threaded channel formed therein so that when the two body portions are interdigitated about the shaft, the resulting body member has a channel drawn from its outer surface to its inner surface.

The locking member, which may be a screw or the like, fits into the channel and functions to secure the two body portions together, while allowing the shaft to slidably move through the central aperture when not engaged therewith.

When fitted together, the threaded screw secures the body member to the shaft in position by pressing the shaft against the inner surface of the body member. The body member is now in a fully locked position. In the fully locked position, the body member is restricted from slidable movement along the bottom portion of the shaft. The body member does not move relative to any portion of the shaft. The body member has a sufficient weight or mass such that in executing a tennis swing the centripetal force created thereby forces a proper swing.

The tennis-swing shaft, preferably, is disposed in part in the area formed between the head and the rim of the racket to position one or more weights, of the same, or different mass, or as desired, either closer to the rim or closer to the head to provide a tennis swing practice or warm-up weight. If desired, the shaft may be tapered.

The tennis-swing shaft may have a generally smooth exterior surface, or provided with a series of recesses and/or detents, or threaded. The weight and screw-like locking member, described hereinabove, would be locked to the shaft provided with the screw-like member engaging the smooth exterior surface or interlocking with one the detents.

In a preferred embodiment according to this invention, the shaft comprises a generally hollow cylindrical tube, the tube being open at one end and internally threaded whereby to receive and threadably engage with a threaded stem, a first U-shaped bracket fixedly disposed on the stem and adapted to engage with the handle, and a second U-shaped bracket rotatably mounted to the other end of the tube and adapted to engage with the rim. The shaft could be positioned such that the rotatable bracket engages with the handle. Rotation of the stem relative to the cylinder in first and second opposite directions, respectively, causes the brackets to move axially away from one another and into engagement with the tennis bracket handle and head, and towards one another and from engagement with the racket and be removed therefrom, if desired.

Additionally, the weight could be, preferably, generally cylindrically shaped and have a central bore for fitment to the shaft, such as the weight having the opposed interdigitating body portions as described hereinabove.

In one arrangement, the cylindrically shaped weight is integrally formed and the wall of the central bore provided with thread to threadably engage with the exteriorly threaded shaft. Additionally, in another arrangement, the cylindrically shaped weight includes a hollow extending radially between the central bore and outer periphery of the weight and within which is mounted a spring biased locking member, the locking member having an inward end being biased radially inwardly to engage a selected detent.

The mounting of the shaft to the tennis racket preferably aligns the axis of the shaft so as to be generally coaxially aligned with the axis through the handle (and through the geometric center) of the racket.

In one preferred embodiment, described hereinabove, the mounting arrangement comprises the opposed pair of U-shaped mounting brackets that are moved towards or away from one another, depending on the rotation of the shaft portions.

In another preferred embodiment, the mounting arrangement comprises first and second pin members, each located at one and the other respective end of the shaft and spring biased for movement between a first position outwardly of the shaft end and a second position retracted inwardly of the shaft end, and first and second detents, the first detent being located in the handle for receiving the first pin and the second detent being located in the head for receiving the second pin.

The present invention will be more clearly understood with reference to the accompanying drawings. Throughout the various figures, like reference numerals refer to like parts in which:

BRIEF DESCRIPTION OF THE FIGURES

FIGS. 1 and 2A–2B depict an embodiment of a tennis swing training device provided with a removable shaft for mounting a weight member.

FIG. 3 is a cross-sectional view of the weight member shown in FIG. 1.

FIGS. 6–10 are views depicting preferred embodiments of tennis swing devices according to this invention and arrangements for positioning the weight member and adjusting the resultant center of gravity of the tennis swing training device.

DETAILED DESCRIPTION OF PREFERRED EMBODIMENTS OF THE INVENTION

Figure 4:
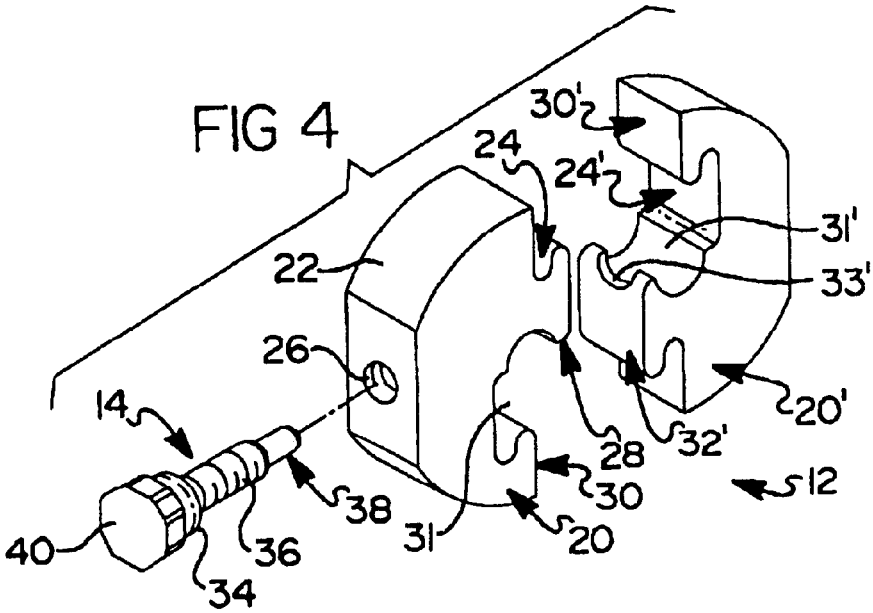
FIG. 4 is an exploded, top view of the weight member shown in FIG. 1.

Referring now to the drawings, according to the invention herein, there is provided a tennis training device in the form of an improved arrangement for weighting the racket, the arrangement providing control over the center of gravity of the weighted racket, centering a weight adding shaft coaxially with the hand and head portions of the racket, adjusting the combined weight of the racket, and placement of the weight relative to the racket and the resultant balance of the racket. The placement of weight(s) on the racket is beneficial either in warm-up exercises, actual play, or during practice to develop the "perfect serve". The addition of weight to the racket enables the user to simulate the load that would be experienced during the actual game. Indeed, because the tennis player must be able to have the arm strength to make plays that are close to the net or far therefrom when volleying, the ability to change the balance and center of gravity of the racket becomes important for the well-rounded player. Generally, it would be desirable to provide the player with a racket wherein additional weight may be added at a location near to the stringed-head, or to the handle, or at intermediate locations between the head and the handle, as desired. The overall balance of the racket is important relative the hand and its ability to grasp and maneuver the handle.

It is to be appreciated that such device can be used advantageously with a tennis racket, a badminton racquet, or a training racket designed solely to be used in temporarily adding supplemental weights to strengthen critical parts of the arm. Provision of a racket or like training apparatus to which weight may be temporarily added may be used in situations wherein the player wants to maintain his body in peak condition even when access to a court is not feasible.

The tennis-swing training device generally comprises a conventional tennis racket that includes head and handle portions, a shaft or weight mounting rod in a central area formed between the portions, and at least one weighted member or weight which removably fits about the shaft.

Turning to FIG. 6 there is shown a conventional tennis racket, generally denoted by the number 76. The racket 76 comprises a head or rim 78 which is substantially circular or oblong in configuration, an elongated handle 80, and a pair of lateral support members 82 which connect the rim to the handle and define an area 84 between the head and the handle wherein weights can be added and/or positioned. An array of criss-crossed interlaced strings 86 is provided in the interior of the rim.

Preferably, the racket 76 is provided with a weighting arrangement 88 whereby the user can add weight members as desired and adjust the balance of the racket and/or place the center of gravity closer to the head or to the handle.

In the preferred embodiment as shown in FIG. 2A, the weighting arrangement 88 includes an elongated shaft 90 having a first end 92 spaced axially from a second end 94, a first pin member 96 associated with the first end 92, a second pin member 98 associated with the second end 94, a first detent 100 in the head 78 adapted to receive the first pin member 96, and a second detent 102 in the handle 80 adapted to receive the second pin member 98. The shaft 90 is generally of uniform cross-section and adapted to have has its geometric axis "A" arranged coaxially with the axis "H" of the handle 80 and extending through the center of the handle and the central area "C" of the head portion 78.

The first and second pin members 96 and 98 are adapted to mount the shaft 90 to the racket 76. Each pin member 96 and 98 is spring biased in its respective shaft end portion and adapted to be securedly removably received in its associated detent 100 or 102. In this regard, each shaft end portion is suitably hollowed whereby to define a socket for receiving a biasing member such as a coil spring that forces its associated pin member outwardly from the shaft. The arrangement for captivating the pin members in the shaft ends are similar and the arrangement will be described in connection with the shaft end 94.

Referring to FIG. 2B, the shaft end 94 includes a hollow or socket 104, a biasing member in the form of a coil spring 106, a shoulder 108 on the pin member 98, and a centrally apertured closure cap 110 fitted to the shaft end to captivate the pin member in the socket. So captivated, the spring member 106 engages the shoulder 108 to normally force the pin outwardly for receipt in the detent 102. For mounting, the pins 96 and 98 are forced against the rim 78 and/or handle 80, causing the pins to be forced inwardly of the socket, as shown by the arrow "P". Inward retraction of the pins into their respective sockets allows the shaft 90 to fit between the rim and the handle, and the pins to be positioned over the detents 100 and 102 whereupon the coil springs 106 force the pins outwardly and into engagement with the respective detents.

Figure 5:
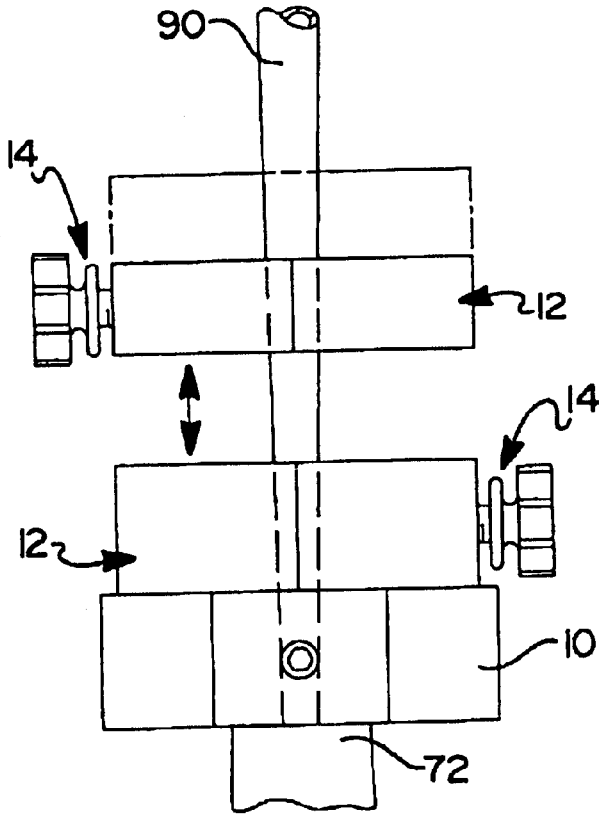
FIG. 5 is a side-view of an embodiment of the tennis swing device of FIG. 1 wherein the shaft is tapered and has a plurality of weights mounted thereon.

Referring to FIGS. 3–5, and as described in the co-pending application, a preferred embodiment of the weighted member 10 includes a body member 12 and a locking member 14. The body member 12 is, preferably, a cylindrical, substantially, planar member which has a first aperture 16 which is designed to slidably encircle the shaft 90. The body member 12 may be formed of a variety of materials including various dense metals, such as steel, iron, bronze, etc. The weight of the member 10 is a predetermined weight and which ordinarily will vary from about two to ten pounds in weight. Thus, where a plurality of members 10 are mounted about the shaft, the weight of one particular weighted member may differ from another weighted member, as described herein below.

The body member 12 comprises a pair of opposed body portions 20, 20', which are, preferably, substantially identical and opposedly arrayed, and which interdigitate to form the body member 12. Since the two body portions are, usually, identical for purposes of clarity, the description will only reference one of the body portions, the body portion 20.

The body portion 20 has an outer surface 22, an inner surface 24, and a channel 26, drawn between its outer surface 22, and an inner surface 24, respectively. The channel 26 is, preferably, a threaded channel.

The inner surface 24 of the body portion 20 has a first interdigitating member or foot 28, and a second interdigitating member or pedestal 30.

Since, in use, the two body portions 20, 20' are opposedly arranged, the first interdigitating member or foot 28 of the body portion 20 interdigitates with the second interdigitating member 30, of the other body portion 20' to form the body member 12.

The first interdigitating member 28 of the body portion 20 includes a flange 32.

When the two opposedly arranged body portions 20, 20' are interlocked, the flange 32, defines a portion of the edge of the first aperture 16 formed through the body member 12. The flange 32, has a semi-circular notch 33, cut into it. The semi-circular notch 33 of the flange 32 communicates and is coaxial with the channel 26 of the opposedly arranged body portion 20.

As shown in FIG. 4, the pedestal 30 extends inwardly from the periphery of perimeter of the surface 22. A U-shaped core or recess is provided rearwardly of the pedestal 30, as shown. The recess has a width slightly larger than that of the opposed foot 28' of the other body member so that it nests therein. Each foot 28 or 28' is disposed or formed interiorly of the respective body portion.

Each body portion 20 and 20' has a shoulder 35 and 35' formed above the interior opening above the associated channel 26 or 26'. The opposed foot 28 or 28' seats in the opposed shoulder upon interdigitation with its associated notch, cooperating to "round off" the interior opening, as shown. The interior portion of each foot nests in an opposed recess 31 or 31'. Likewise, the interior portion of each pedestal nests in the cut-out provided rearwardly of each foot, as shown.

A locking member 14 such as a helically threaded fastener or screw 34 or other suitable means for fastening may be projected or threaded through the channel 26 to lock the two body portions together as well as to secure the device 10 to the shaft 90.

Where the channel 26 is threaded, a threaded fastener is used. The helically threaded fastener has a threaded portion 36, a bearing surface 38 and a finger or head portion 40.

The threaded portion 36 of the locking member 14 is helically threaded so as to be received by either of the helically threaded channels 26 of the two substantially identical body portions 20 and 20'. Additionally, the bearing surface 38 of the locking member 14 is preferably made of soft metal or plastic to prevent damage to the shaft 90. The finger or head portion 40 is designed to allow a person to easily grasp and manually turn the fastener 34.

When the body portions 20 and 20' are interdigitated and the helically threaded fastener is inserted into one of the helically threaded channels 26 and 26' so that the bearing surface 38 of the helically threaded fastener 34 is just short of protruding into the first aperture 16 of the body member 12, the two portion are secured together although the shaft is not secured, since the fastener has a length greater than either channel. This is the semi-locked configuration which allows positioning of the weight on the shaft.

In this configuration, a small section 40 of the helically threaded portion 36 of the helically threaded fastener 34 engages the semi-circular notch 33 and 33' of the flange 32 and 32' on the first interdigitating member 28 or 28' of the opposedly arranged body portion 20 and 20'.

When the bearing surface 38 of the fastener 34 protrudes into the first aperture 16 of the body member 12 and bears against the shaft 90, the two body portions 20 and 20' are locked together and the body member 12 is positioned in place relative to the shaft 90.

Preferably, the outer diameter and/or cross section of the shaft 90 and the aperture in the weight member are substantially the same, with the shaft being dimensioned to be slightly smaller that the aperture, thereby enabling one or more weight members to be slidably positioned and removably secured to the shaft. Adjustment of the head portion 40 of the threaded fastener secures the weight member at a selected position along the length of the shaft. In this regard, the fastener end 38 is driven inwardly and into engagement with the outer surface of the shaft 90, in a manner as described hereinabove.

The shaft 90, so mounted to the racket 76, positions the weight member 10 in the open area 84. Adjustment of the locking member 14 causes the bearing surface 38 to engage, or be removed from engagement, with the shaft, and at least one weight member 10 to be positioned closer to the handle, or to the rim, as desired.

It is to be understood that the arrangement for mounting the shaft 90 to the racket 76 can be other than shown hereinabove in connection with the pins and detents.

As shown in FIG. 5, the shaft 90 may be tapered and be adapted to mount several weights 10 thereon in axially spaced relation. The shaft taper orients an enlarged diameter portion of the shaft 90 so as to be adjacent one or the other of the respective head 78 or handle 80. If adjacent to the reduced diameter portion of the shaft, the head 78 or handle 80 forms an abutment or stop 72 for stopping movement of the weight member in a direction away from the enlarged diameter portion, such as during a swinging motion.

In an alternative preferred embodiment according to the present invention, as depicted in FIG. 6, an axially elongated shaft 112 is provided with a series of recesses or detents 114 arranged linearly or as otherwise desired between the ends of the shaft, the detents 114 being adapted to receive the inward bearing end 38 of the fastener. In this arrangement, at least one (or more) weight member(s) 10 can be accurately placed at predetermined locations along the length of the shaft 112, one weight 10 being shown in phantom, thereby ensuring reproducibility in weight placement in succeeding practices.

In another alternative preferred embodiment according to the present invention, as shown in FIG. 7, an elongated shaft 116 is externally threaded between its opposite ends, and at least one (or more) weight member(s) 118, similar is size and shape to the weight member 10, is mounted to the shaft. In this embodiment, the weight member 118 preferably comprises a generally cylindrical disc that has a central bore 120 extending between its opposite faces 122 and 124, the wall of the bore 120 being provided with thread that is complementary to the thread formed on the shaft 116. In such arrangement, the weight member 118 is infinitely positionable between the opposite axial ends of the shaft 116 by threadably advancing the weight member 118 towards one of the shaft ends, as desired, thereby changing the balance and/or center of gravity of the racket 76. The weight member 118 is adapted to be positioned on the shaft 116 in the open area 84 as described hereinabove with respect to the weight member 10 and the shaft 90.

The shaft 116 includes the spring biased pin members as described in connection with the shaft 90 and the mounting of the shaft to the detents in the tennis racket would be the same as the described in connection with the shaft 90.

In yet another alternative preferred embodiment according to this invention, as shown in FIG. 8, an axially elongated shaft 126 is provided with an array of recesses or indents 128 spaced axially along its outer periphery, and at least one (or more) weight member(s) 130 is mounted for movement along the length of the shaft 126. The weight member 130 is generally in the shape of a cylindrical disc and has a central bore 132 extending between its opposite faces 134 and 136. The central bore 132 has a cross-section slightly greater than that of the shaft whereby to provide a clearance fit therebetween and allow the weight member 130 to slide along the shaft 126.

A chamber 138 extends radially between the central bore 132 and the outer circumferential surface 140 of the weight member 130. To secure the weight member 138 to the shaft 126, a locking pin 142 having a locking portion 144 and an actuating portion 146 is mounted for reciprocating movement relative to the chamber 138, the locking portion 144 being biased radially inwardly into the central bore 132 by a biasing member in the form of a coil spring member 148. The locking portion 144 is dimensioned to extend into the central bore 132 whereby to interlock with a selected one of the recesses or indents 128.

To position, release and reposition the weight member 130, the user pulls the actuating portion 146 radially outwardly and in a direction away from the outer circumferential surface 140, against the resistance of the spring member 148, thereby retracting the locking portion 144 from the central bore 132 and enabling the weight member 130 to move axially relative to the shaft 126 and be positioned adjacent to a desired indent 128 along the length of the shaft 126. The locking pin 142 is then released, whereupon the spring member 148 drives the locking portion 144 into engagement with the selected indent 128 along the shaft 126, thereby locking the weight member 130 relative to the shaft 126.

The shaft 126 includes spring biased pin members as described hereinabove in connection with the shaft 90 and the mounting of the shaft 126 to the detents in the tennis racket 76 would be the same as the described in connection with the shaft 90.

An alternative preferred embodiment of a tennis training device according to this invention, generally denoted by the reference numeral 150, is shown in FIGS. 9 and 10. According to this embodiment, the training device 150 is in the form of the tennis racket 76 and comprises an axially elongated shaft 152 that is removably mounted to the tennis racket 76.

As shown best with reference to FIG. 9, the shaft 152 comprises a hollow generally cylindrical tube or sleeve 154 and a threaded stem 156. The tube 154 has opposite ends 158 and 160 and is open at one end 158 and closed at the other end 160, the inner wall of the cylinder, at least proximate to the open end 158, being provided with thread 162 that is adapted to threadably engage with the thread on the stem 156 whereby to secure an axial end portion of the stem to the tube 154.

For mounting the shaft 152 to the tennis racket, a first retention member or bracket 164 is fixedly disposed at one end of the stem 156 and a second retention member or bracket 166 is rotatably disposed on the closed end of the tube. The retention members 164 and 166 are generally U-shaped and axially aligned with one another and with the axis of the tube 154. The second retention member or U-shaped bracket 166 is fixedly attached to the cylinder, such as by a rivet 168, but fixed in such a manner that the bracket 166 may rotate relative to the tube 154 and the axis "A" thereof. The first retention member 164 is adapted to fit snugly onto and over the upper end portion of the handle 80. The second retention member 166 is adapted to fit snugly onto and about the cross-section of the lower end portion of the head 78.

The shaft orientation could be reversed wherein the bracket 164 would engage with the head 78 and the bracket 166 would engage with the handle 89. Further, the rotatable bracket could be pivotably secured to the stem and the stationary bracket fixed to the closed end of the sleeve.

Manual rotation of the outer cylindrical tube or sleeve 154 relative to the stem 156, in first and second opposite directions, respectively, due to the threadable interengagement therebetween, causes the stem 156 and the tube or sleeve 154 either to move axially away from one another and the brackets 164 and 166 to be driven into a snug engagement with the tennis bracket handle and head; or to move towards one another and the brackets 164 and 166 to be drawn away from retaining engagement with the racket. In FIG. 10, the brackets 164 and 166 are shown (in phantom) in snug retaining relation to the lower end portion of the head 78 and the upper end portion of the handle 80.

Preferably, a weight member (not shown) is mounted to the tube 154 of the shaft 152 so as to be disposed in the open area 84 of the shaft. Preferably, the weight member may be the weight member 10, as described hereinabove.

The improved tennis racket weighting devices and mounting arrangements herein are particularly advantageous for temporarily adding supplemental weight to a racket in order to develop a better shot by strengthening the critical parts of the arm.

Having, thus described the present invention, what is claimed is:

1. A tennis-swing training device, said device comprising:

(a) a racket, said racket comprising a stringed head having a lower end portion, a handle having an upper end portion, and a pair of beams connecting the head to the handle and defining an open area between the upper and lower end portions thereof;

(b) a shaft having a first end and a second end and a medial portion between the ends of the shaft;

(c) means for mounting the shaft to the racket whereby the first end is proximate to the upper end portion of the handle, the second end is proximate to the lower end portion of the head, and the medial portion is proximate to the open area; and (d) means movably mounted on the medial portion of said shaft and positionable in the open area for changing the balance and the resultant center of gravity of the tennis racket, wherein said means movably mounted on the medial portion of said shaft comprises a weight mounted for movement in the open area between the head and handle portions, the weight comprising:

(1) first and second interdigitating opposedly arranged body portions; and (2) at least one locking member for locking the first and second body portions together into a resulting body member and securing the body member to the shaft, the locking member precluding the slidable movement of the body member relative to the shaft.

2. The device as claimed in claim 1, wherein said shaft is generally cylindrical, and at least one of the two body portions of the weight has a threaded channel formed therein so that when the two body portions are interdigitated about the shaft, the resulting resulting body member has a channel drawn from its outer surface to its inner surface.

3. The device as claimed in claim 2, wherein said mounting means for mounting the shaft to the racket comprises:

a pair of generally U-shaped brackets, the brackets being disposed on opposite axial end portions of the shaft and the U-shaped portions opening in opposite axial directions, and means associated with the shaft for moving the brackets in opposite axial directions and towards and away from one another, movement of the brackets in one of said directions moving the U-shaped portions of the brackets away from one another and into seating engagement about the end portions of the handle and the head proximate to the open area, and movement of said brackets in the other of said directions moving the brackets towards one another and from seating engagement with the racket thereby enabling the shaft to be removed from the racket.

4. The device as claimed in claim 2, wherein said shaft comprises an externally threaded stem, a sleeve having first and second end portions, the first end portion forming an internally threaded socket adapted to receive and threadably engage with the stem, means for fixedly mounting one of said U-shaped brackets to one of said stem and said second end portion of said sleeve, and means for rotatably mounting the other of said U-shaped brackets to the other of said stem and said second end portion of said sleeve.

5. The device as claimed in claim 1, wherein said shaft is externally threaded between the first and second ends of the shaft; and said means movably mounted on the medial portion of said shaft comprises at least one weight member, said weight member including a threaded bore adapted to threadably engage with the shaft be positioned in the open area between the upper and lower end portions of the head and the handle of the tennis racket.

6. The device as claimed in claim 1, wherein said shaft is provided with a series of detents between the first and second ends of the shaft; and said locking member is engageable within a selected one of said detents whereby to lock the weight member in the open area between the upper and lower end portions of the head and the handle of the tennis racket.

7. The device as claimed in claim 1, wherein said shaft is provided with a series of detents between the first and second ends of the shaft; and said means movably mounted on the medial portion of said shaft comprises a weight mounted for movement in the opening between the head and handle portions, the weight comprising:

a body member having a central bore adapted to fit about said shaft and an outer periphery, and at least one locking member extending radially between said bore and said outer periphery, said locking member having a locking portion mounted for inward radial movement and engagement with a selected one of said detents for securing the body member to the shaft and precluding slidable movement of the body member relative to the shaft.

8. The device as claimed in claim 1, wherein said racket has a central axis extending through the head and the handle, said shaft has a central axis extending between the first and second ends thereof, and said means for mounting the shaft to the racket arranging the axes to be generally coaxially aligned with one another.

9. The device as claimed in claim 1, wherein said mounting means for mounting the shaft to the racket comprises:

a first and a second detent, respectively, in the upper and lower end portion of the handle and the head of the racket; and a first and a second pin member, respectively, in the first and second end of the shaft, the pin members extending in opposite axial directions from their respective ends and spring biased relative to the shaft whereby to retract within and be biased outwardly of the shaft end to seat within the first and second detents and secure the shaft to the racket.

10. A swing training device, said device comprising:

a frame having first and second end portions spaced apart along a central axis and a central opening disposed between said end portions, the first end portion adapted to be grasped by the hand of a player when swinging the frame;

an elongated axial shaft having first and second ends and a medial portion;

means for removably securing said shaft to said frame such that said shaft is disposed entirely within said central opening, said means for removably securing comprising a first generally U-shaped bracket adapted to engage said first end portion, a second generally U-shaped bracket adapted to engage said second end portion, means for journaling said first bracket to the first end of said shaft in a manner that enables the first U-shaped bracket to rotate but not translate relative to the shaft, and means for threadably connecting said second bracket to the second end of said shaft in a manner that enables the second U-shaped bracket to move axially towards and away from the shaft; and at least one weight member movably mounted on the medial portion of said shaft whereby to adjust the center of gravity and weight balance of the frame, the weight comprising:

(1) first and second interdigitating opposedly arranged body portions; and (2) at least one locking member for locking the first and second body portions together into a body member and securing the body portions to the shaft, the locking member precluding the slidable movement of the body member relative to the shaft, wherein fitment of the brackets to the frame portions and relative rotation of the shaft in one direction drives the brackets axially away from one another and into snug engagement with the respective frame portions, and in the other direction, draws the brackets axially towards one another and from engagement with the frame portions.

11. The device as claimed in claim 10 wherein a plurality of weight members, of the same or different weight, are disposed along said medial portion.

12. A swing training device for a tennis racket, said racket including an annular head having a base portion and an elongated handle connected to and extending from said base portion toward a grip remote therefrom and defining an open area between said head and said handle, the swing training device comprising:

a weight element; and means for removably attaching said weight element in the open area of said racket, said means for removably attaching comprising an axial shaft having first and second end portions and a medial portion, and a first and second bracket adapted to be connected, respectively, to one and the other of said base and handle, said first bracket being axially immobilized and journalled for rotation relative to said first end portion, and said second bracket being threadably connected to and axially drivable towards and away from the second end, wherein connection of the brackets to said racket and rotation of the shaft relative to said brackets causes the second bracket to be driven axially and into or from snug engagement with the racket, and further including at least one locking member for adjustably connecting the weight element at a desired axial location along the medial portion of said shaft, wherein said weight element comprises first and second interdigitating opposedly arranged body portions; and said locking member locks the first and second body portions together into a body member and secures the body member to the shaft, the locking member precluding axial slidable movement of the body member relative to the shaft.

13. The swing training device as claimed in claim 12, wherein the second bracket includes a body portion extending axially, the body portion being provided with a first thread, and the second end portion of said shaft is provided with a second thread extending axially, the first and second thread being adapted to threadably mate with one another and depending on the direction of threadable interengagement causing the second bracket to axially advance towards or away from the second end of the shaft.

14. The swing training device as claimed in claim 13, wherein the body portion comprises an externally threaded axial stem formed with said first thread, and an internally threaded axial bore formed with said second thread extends axially inwardly from the second end of said shaft, said bore being dimensioned to receive said stem and the first and second thread to matingly interengage.

* * * * *